US005522401A

United States Patent [19]

Brucker

[11] Patent Number: 5,522,401

[45] Date of Patent: Jun. 4, 1996

[54] STOMACH MUSCLE/POSTURE MONITORING BELT

[76] Inventor: Milton Brucker, 10110 Empyrean Way, Los Angeles, Calif. 90067

[21] Appl. No.: 377,280

[22] Filed: Jan. 23, 1995

[51] Int. Cl.[6] ..... A61B 5/103

[52] U.S. Cl. ..... 128/781; 482/148; 482/909

[58] Field of Search ..... 482/909, 148; 128/721, 780, 782, 845; 340/573; 116/67 R; 273/183.1, 187.2; 446/357, 406, 415

[56] References Cited

U.S. PATENT DOCUMENTS

| | | | |
|---|---|---|---|
| 1,619,184 | 3/1927 | Bregman | 446/406 |
| 2,064,603 | 12/1936 | Harrison | 116/67 R |
| 2,220,593 | 11/1940 | Watson . | |
| 2,263,670 | 11/1941 | Arkin | 340/573 |
| 3,278,185 | 10/1966 | Bidopia et al. . | |
| 3,582,935 | 6/1971 | Verhaeghe . | |
| 3,608,541 | 9/1971 | Hall . | |
| 3,670,320 | 6/1972 | Palmer . | |
| 3,820,529 | 6/1974 | Gause et al. . | |
| 4,114,311 | 9/1978 | Chow | 446/406 |
| 4,191,949 | 3/1980 | Myers . | |
| 4,392,126 | 7/1983 | Loyola . | |
| 4,775,148 | 10/1988 | McLaughlin . | |
| 4,801,921 | 1/1989 | Zigenfus . | |
| 4,846,462 | 7/1989 | Regnier et al. . | |
| 4,871,998 | 10/1989 | Chaillou . | |
| 4,914,423 | 4/1990 | Fernandez . | |
| 5,027,442 | 7/1991 | Taylor | 446/415 |
| B1 4,775,148 | 11/1992 | McLaughlin . | |

FOREIGN PATENT DOCUMENTS

| | | | |
|---|---|---|---|
| 9106082 | 6/1991 | WIPO | 340/573 |

*Primary Examiner*—Richard J. Apley
*Assistant Examiner*—Jeanne Clark
*Attorney, Agent, or Firm*—Christie, Parker & Hale

[57] ABSTRACT

A stomach muscle monitoring/warning device includes a belt housing with a slide plate that moves a pin into contact with a flexible sounding spring inside the belt housing to mechanically produce a subtle audible clicking sound when the stomach muscles are expanded beyond a preset limit for warning the user to retract the stomach muscles to improve posture.

4 Claims, 4 Drawing Sheets

STOMACH MUSCLE/POSTURE MONITORING BELT

FIELD OF THE INVENTION

This invention relates to a belt for improving posture by sensing expansion of the abdominal muscles and providing a warning sound when stomach muscle expansion exceeds a preset limit.

BACKGROUND OF THE INVENTION

At present there is a well-recognized need for regular physical exercise for its cardiovascular benefits, to overcome weight problems and to improve muscle tone. It is often the case that persons who exercise regularly and do not have weight problems, as a habit, will lapse into poor posture that makes it appear they are overweight. The problem has been recognized as lack of proper control over the abdominal muscles. To confront this problem various abdominal muscle expansion warning devices have been developed. They are typically worn as a belt around the waist, and when the user's stomach muscles expand against the belt line to a preset maximum, thereby indicating poor posture, the warning device sounds or otherwise warns the user that he has allowed the abdominal muscles to relax beyond the desired limit. The user can then tighten the abdominal muscles and immediately regain proper posture. Such warning devices can have the advantage of retraining the stomach muscles if the warning devices are used constantly, so that everyday use can ultimately produce good posture as the norm. Good posture also can have the benefit of alleviating chronic back problems or other undesired physical symptoms of poor posture.

The present invention is based on a recognition that prior posture monitoring and warning devices which are worn as a belt are not useful as a practical matter in being wearable constantly throughout the day, particularly in social situations, such that the user would want to constantly wear the belt on an ongoing basis.

Most prior belt-type devices having posture warning systems contain variations of electronic circuits to produce audible sounds such as a buzzer or an alarm. Most electronic devices produce a continuous audible sound. Other warning devices either generate a light signal as an alternative, or others use a mechanical vibrating action to warn the user of poor posture.

There is a need for an abdominal expansion monitoring and warning device that is capable of sensing and warning the user about abdominal muscle expansion beyond a preset limit, without the use of electronic monitoring or warning devices which generate a loud or continuous audible alarm sound. This can be annoying in public and would otherwise discourage the user from wearing the belt continuously from day to day. Such electronic devices also are unduly complicated and costly to manufacture. There is also a need for such a monitoring/warning device which is not readily noticeable when being worn and may be easily worn under the clothing separate and apart from a normal belt for trousers or the like. Further, there is a need for a posture warning device that does not add an uncomfortable amount of weight, can easily be used to set the expansion limit, and is reliable in its operation.

SUMMARY OF THE INVENTION

Briefly, one embodiment of the invention includes a belt housing attached to an adjustable belt strap. The length of the belt strap is adjustable, and the adjustment sets a limit at which the monitoring/warning device contained in the belt housing will emit an audible sound when the stomach muscles expand beyond a preset limit. The housing includes a fixed base and a slide plate that slides in the housing relative to the fixed base plate. A control spring is connected between the slide plate and the base plate, and the slide plate moves under the control of the spring. The slide plate is secured to one end of the belt strap and can slide relative to the base plate, outwardly from the housing, against the bias of the control spring, as the stomach muscles expand and apply tension to the belt. The housing further includes a flexible sounding spring and a dowel pin that move relative to each other and into contact when the slide plate moves relative to the housing. Outward travel of the slide plate moves the sounding spring and pin into contact that causes the sounding spring to flex and produce a subtle instantaneous audible sound when the flexing force is released and the spring bypasses the pin. This subtle sound is produced at the point set by the belt length adjustment and reminds the user to tighten the stomach muscles to reduce the sensed abdominal muscle expansion.

The subtle audible sound, which in one embodiment can be a relatively quiet "clicking" sound, is a short impulse-type audible sound lasting for a fraction of a second. It is not produced continuously while the abdominal muscles are under expansion. The warning device is purely mechanical in function and does not generate an electronically produced alarm or buzzer sound that can be annoying and discouraging to the user when the belt is worn in public such as in social gatherings.

In one embodiment, the slide plate can move in a reverse direction when the stomach muscles are contracted, causing the slide plate to be retracted into the housing under the bias of the control spring. This causes the contact between the sounding spring and the dowel pin to flex the sounding spring in the reverse direction, thereby generating the same subtle audible mechanical impulse-type sound when the muscle expansion is immediately corrected. This reverse movement allows the user to quickly and easily check the setting of the belt by producing a short "click, click" sound when the stomach muscles are voluntarily expanded and contracted in a rapid fashion.

An advantage of the invention is its simplicity in construction and greatly reduced production cost in that the device is purely mechanical in function and requires no electronic control devices, sensors, batteries, or continuous warning devices that emit loud sounds.

These and other aspects of the invention will be more fully understood by referring to the following detailed description and the accompanying drawings.

DETAILED DESCRIPTION

Figure 1:
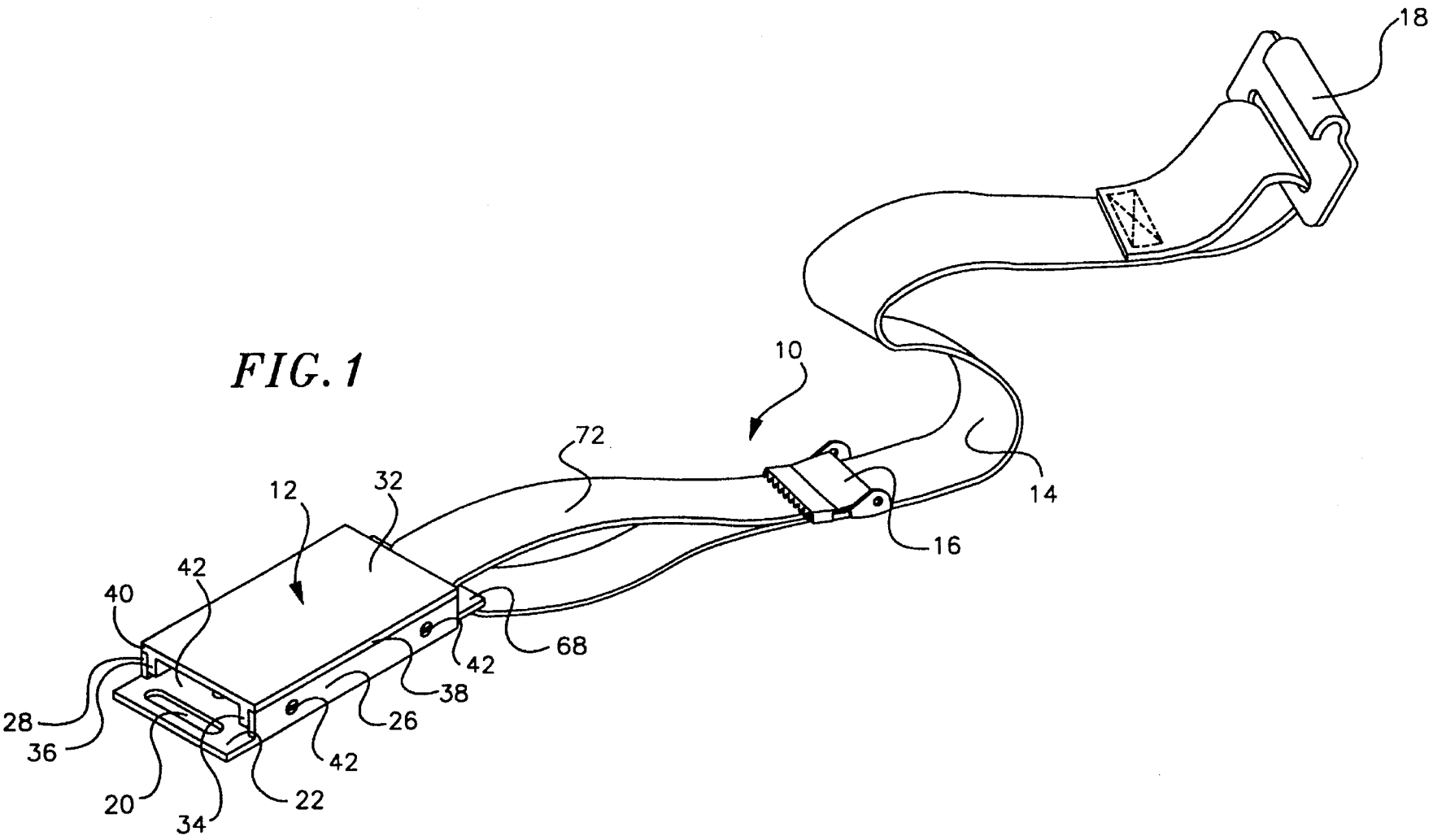
FIG. 1 is a perspective view showing a stomach muscle/posture monitoring and warning device.

FIG. 1 is a perspective view illustrating a stomach muscle monitoring and warning device 10 which includes a low profile belt housing 12 and an elongated belt strap 14 secured to a portion of the belt housing. The belt strap has a conventional slide adjustment 16 at an intermediate location for adjusting the effective length of the belt. A hook 18 is rigidly secured to a free end of the belt strap. The hook is releasably secured to an elongated slotted opening 20 on a projecting end portion 22 of the belt housing for holding the belt around the waist or abdominal region of a user. The belt housing 12 is normally worn separate from a conventional belt (not shown) worn on trousers or the like. An important feature of the invention is its ability to be worn without detecting it, and therefore, it is adapted for being worn under the clothing with the belt housing positioned on the stomach muscle region to sense expansion or contraction of the stomach muscles.

Figure 2:
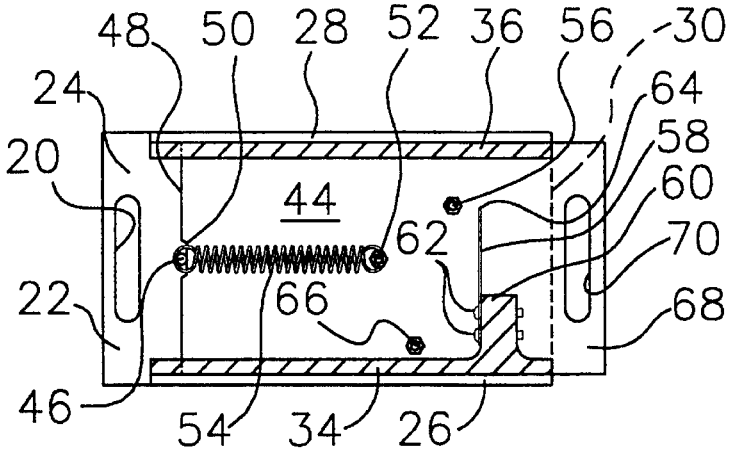
FIG. 2 is a top plan view showing a first embodiment of the invention in which the interior of a monitoring and warning device has a slide plate in a retracted position. In this view a cover plate is broken away to reveal the components in the interior of a belt housing, and the portions of the cover plate that are located in the interior of the housing are shown in cross section.

FIG. 2 is a top plan view of the belt housing interior showing a slide plate contained in the belt housing in a fully retracted position. This view, in combination with the perspective view of FIG. 1, best illustrates components of the belt housing which include a flat base plate 24 having a pair of integrally formed side walls 26 and 28 extending parallel to one another along opposite sides of the base plate. As shown best in FIG. 2, the ends of the side walls 26, 28 are spaced inwardly from the end portion of the base plate that forms the projecting portion 22 of the belt housing. At the opposite end of the belt housing the side walls 26, 28 extend to an edge 30 of the base plate 24.

Figure 3:
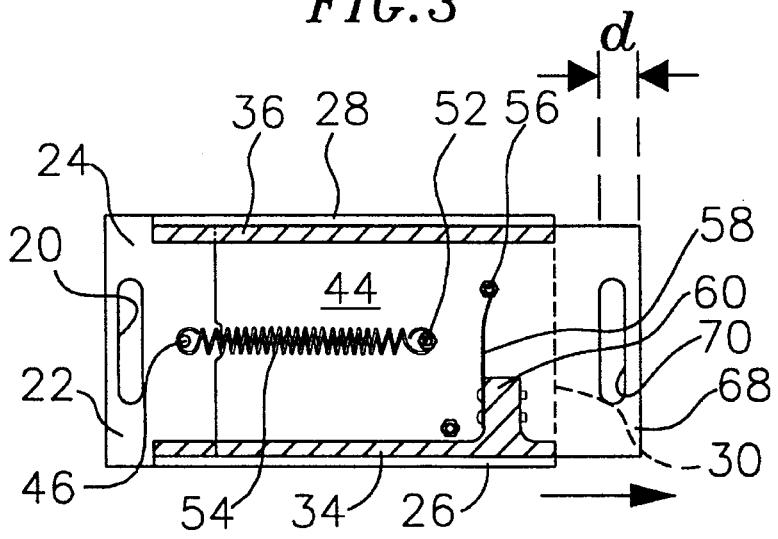
FIG. 3 is a top plan view of the first embodiment similar to FIG. 2 but showing the slide plate having moved a fixed pin into contact with a flexible sounding spring for causing the sounding spring to emit a subtle audible mechanical sound.
Figure 4:
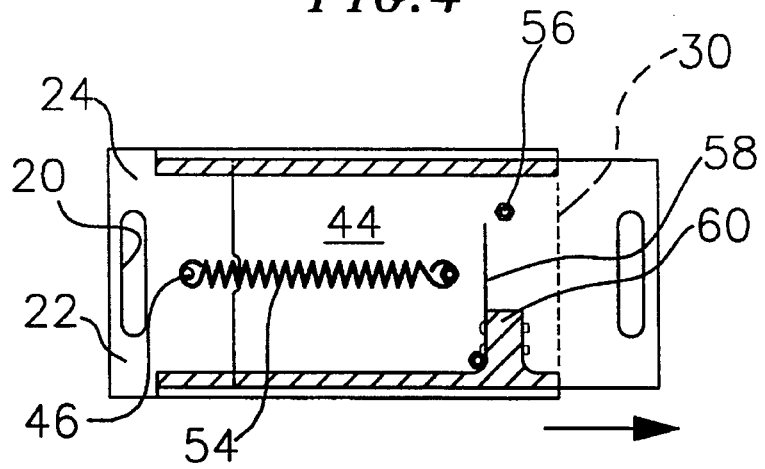
FIG. 4 is a top plan view of the first embodiment similar to FIGS. 2 and 3, but showing the slide plate having moved farther outside the housing.

A cover plate 32 is rigidly secured over the base plate 24 to form a hollow interior region of the belt housing which is best illustrated in FIGS. 2 through 4. The cover plate 32 has a pair of downwardly projecting side walls 34 and 36 extending parallel to one another and which abut against the insides of the base plate side walls 26, 28, respectively. The cover plate 32 is assembled by placing it over the upwardly opening face of the base plate and by engaging the outsides of the cover plate side walls 34, 36 with the insides of the base plate side walls 26, 28 so that flanged outer edges 38 and 40 along opposite sides of the cover plate abut against the tops of the base plate side walls 26, 28. A pair of fasteners 42 rigidly secure the side wall 34 of the cover plate to the side wall 26 of the base plate, and similar fasteners (not shown) on the other side of the belt housing secure the opposite side of the cover plate to the outer edge of the base plate side wall 28. The cover plate, thus positioned and securely fastened to the base plate, provides a generally rectangularly-shaped and elongated hollow interior region within the belt housing. This region is of reasonably low profile so that the overall width of the belt is sufficiently narrow to be non-protruding during use.

An elongated and generally rectangularly-shaped, thin, flat slide plate 44 overlies the base plate 24 so that the plate 44 can slide within the hollow interior of the belt housing. The bottoms of the cover plate side walls 34, 36 are spaced above the upper surface of the base plate to provide narrow slotted regions within the housing that accommodate sliding travel of the slide plate under the bottom edges of the cover plate side walls 34, 36. This provides a means for confining the outer edges of the slide plate for preventing movement of the slide plate away from the base plate and for guiding sliding travel of the slide plate within the housing.

The inside of the belt housing includes an upright fixed first pin 46 rigidly secured to the base plate 24 adjacent a first edge 48 of the slide plate. A recessed region 50 at the center edge portion of the slide plate engages the first pin 46 to act as a stop when the slide plate is in the retracted position shown in FIG. 2. An upright second pin 52 is rigidly secured to the upper surface of the slide plate 44 and projects away from the slide plate and into the hollow interior region within the belt housing. The first and second pins mount an elongated coil-type tension spring 54 which functions as a control spring member during operation of the monitoring and warning device. A third upright pin 56 also referred to as a spring actuating member projects upwardly from the upper face of the slide plate through the hollow interior region of the belt housing on the side of the second pin opposite from the first pin. The third pin is positioned on the slide plate so as to make contact with the end of a long, narrow, flexible spring metal sounding spring 58 which extends through the hollow interior of the housing and is mounted to the underside of the cover plate. Portions of the cover plate are shown in cross section in FIG. 2 to illustrate these components of the cover plate as they extend from the bottom of the cover plate into the hollow interior region of the belt housing. These regions of the cover plate include a projecting mounting bracket 60 formed integrally with the underside of the cover plate and which projects into the hollow interior region of the belt housing toward the third pin 56. The mounting bracket fastens an end of the sounding spring by fasteners 62. The sounding spring extends away from the mounting bracket 60 to a free end 64 that is aligned axially with the third pin 56. The mounting of the sounding spring is thus in a cantilevered fashion to allow the sounding spring to flex under a force applied in either direction to the free end of the sounding spring to flex the spring relative to its fixed attachment to the mounting bracket 60.

The interior of the housing further includes a fourth pin 66 extending uprightly within the housing and rigidly affixed to the upper surface of the slide plate. The fourth pin 66 acts as a stop by moving into engagement with the mounting bracket 60 when the slide plate moves to the position of the housing shown in FIG. 4 and described in more detail below.

FIG. 2 further shows an end portion 68 of the slide plate which projects out of the housing on the side opposite the projecting portion 22. An elongated slotted opening 70 in the projecting portion 68 of the slide plate secures the belt strap 14 to an end of the slide plate. This attachment of the belt to the slide plate 44 also is shown in FIG. 1 where a looped end portion 72 of the belt strap is shown secured to the slotted opening 70 of the slide plate.

During use of the abdominal muscle/posture monitoring and warning device, the belt strap 14 is first adjusted around the abdominal region so as to establish a preset amount of stomach muscle expansion that will sound the warning device. This preset limit is established by the amount of travel of the slide plate out of the housing measured by the distance d shown in FIG. 3. In use, one end of the belt strap is secured to the fixed base plate 24 of the housing and the opposite end of the belt strap is secured to the slide plate. The belt is adjusted so that when the user expands the stomach muscles to a preset limit, the belt tension will increase. This pulls the slide plate out of the housing in the direction of the arrow shown in FIG. 3 to move through the distance of travel d to a point where the sounding spring 58 is contacted by the third pin 56. The spring emits a subtle audible sound when the spring is flexed by contact with the pin and the spring rapidly returns to its normal position as the flexing force is released when the pin bypasses the spring. The sound is generated at the point where the preset maximum limit (set by the belt length adjustment) has been reached. As shown best in FIG. 3, the slide plate 44 slides out of the housing in response to axial tension on the slide plate (caused by stomach expansion which applies corresponding axial tension to the belt), and the fixed pin 56 carried by the slide plate moves into contact with the free end of the sounding spring to flex the sounding spring. Continued travel of the slide plate in the direction of the arrow in FIGS. 3 and 4 causes the pin 56 to travel past the end portion of the sounding spring, and as the spring snaps back to its normal position shown in FIG. 4, when the actuating force is released, the spring emits a subtle impulse-like mechanical audible sound, such as a clicking sound, thereby indicating that the abdominal muscles have expanded to the preset limit.

When the user immediately tightens the stomach muscles or otherwise pulls in on the muscles of the abdominal region, the return spring 54 automatically retracts the slide plate back into the housing in a direction toward its normal position shown in FIG. 2. This causes the fixed pin 56 to move past the end of the sounding spring in the opposite direction and causes another clicking sound as it moves to its retracted position.

FIGS. 5 through 9 illustrate an alternative embodiment of the invention in which the sounding spring is mounted on the slide plate and moves to contact a dowel pin on the base plate of the housing to produce the audible warning sound. The embodiment of FIGS. 5 through 9 is believed to be an improvement over the embodiment of FIGS. 1 through 4 in terms of manufacturing costs. The improvement includes a belt housing having a flat base plate 80 extending between parallel side walls 82 and 84 of the base plate. A cover plate 85 fits over the upwardly-facing base plate, with downwardly extending flanges on opposite sides of the cover plate engaging the side walls 82 and 84 of the base plate when the cover plate fits over the base plate. A separate screw (not shown) fastens the parallel flanges 86 of the cover plate to the adjacent side walls of the base plate to form a closed housing with a hollow interior.

The bottom center of the base plate has an area 87 of enlarged wall thickness, and a slide plate 88 slides on a top surface of the area 87 of greater wall thickness. The slide plate carries a fixed upright first pin 90 (also referred to as a spring actuating member) pressed into the area of greater wall thickness near one end of the base plate. A fixed upright second pin 92 is pressed into the area of greater wall thickness near the other end of the base plate. The outer edges of the slide plate also slide on the top faces of a pair of shoulders 94 and 96 that extend inwardly along the inside walls of the base plate. The second pin is centered near one end of the base plate and holds one end of an axially extending coil spring 98. The opposite end of the spring is secured to a short upright post 100 bent up from the center of the slide plate. The first pin 90 is captive in an elongated slot 102 formed in the slide plate adjacent a sounding spring 104. A sounding spring mounting bracket 106 is formed by bending up a portion of the metal forming the slide plate near the first pin. A pair of screws 108 fasten the spring to the bracket 106 so that the spring extends toward and in front of the first pin. The sounding spring 104 is a spring metal leaf spring and extends beyond the bracket so it can flex when moving into contact with the first pin 90. The elongated slot 102 has its opposite ends positioned to provide stops at opposite ends of travel of the slide plate to limit its travel into and out of the housing.

Figure 5:
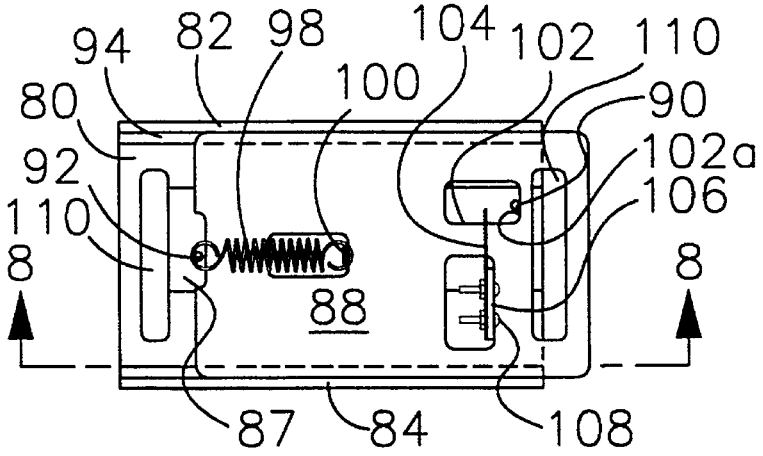
FIG. 5 is a top plan view showing a second embodiment of the invention in which the interior of the belt housing has a slide plate in a retracted position.

FIG. 5 shows the first pin 90 in an at-rest position of the slide plate in which the control spring pulls the slide plate so that a first end **102*a* of the slot 102 engages the pin as a stop to hold the slide plate in its at-rest position. The belt housing is used in a manner similar to the embodiment of FIGS. 1–4 in that the ends of an adjustable belt are secured to elongated slotted openings 110** in the base plate and the slide plate.

Figure 6:
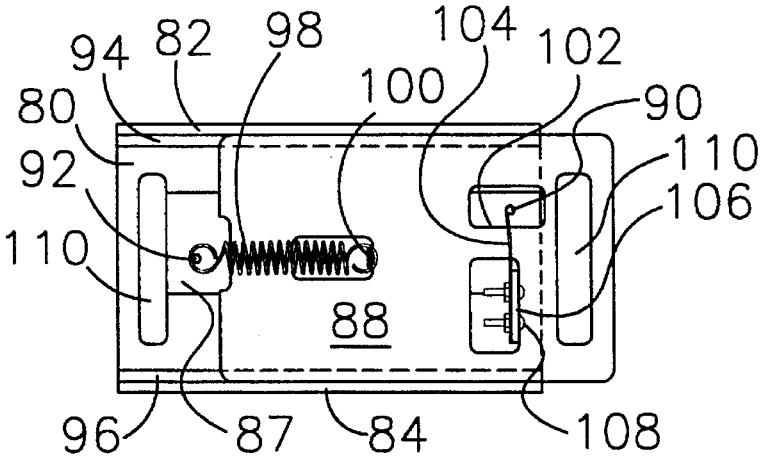
FIG. 6 is a top plan view of the second embodiment similar to FIG. 5 but showing the slide plate having moved to a position for contact between a flexible sounding spring and a dowel pin.

FIG. 6 shows movement of the slide plate outwardly from the belt housing, which carries the sounding spring into contact with the pin 90 thereby flexing the spring to produce the audible sound. The sound is produced by flexing the spring under contact with the pin and moving the spring past the pin, which causes an audible clicking sound. The instantaneous audible sound is produced at the instant the slide plate has been pulled out of the housing and reaches the desired preset limit set by the adjustable belt length.

Figure 7:
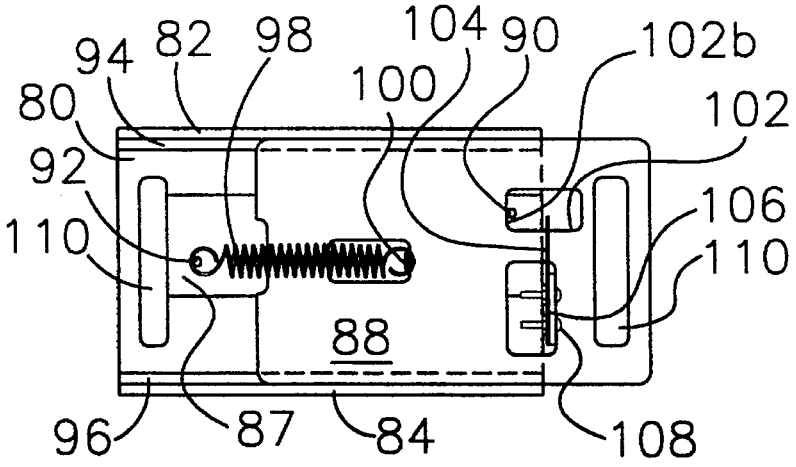
FIG. 7 is a top plan view of the second embodiment similar to FIGS. 5 and 6 but showing the slide plate having moved farther outside the housing.
Figure 8:
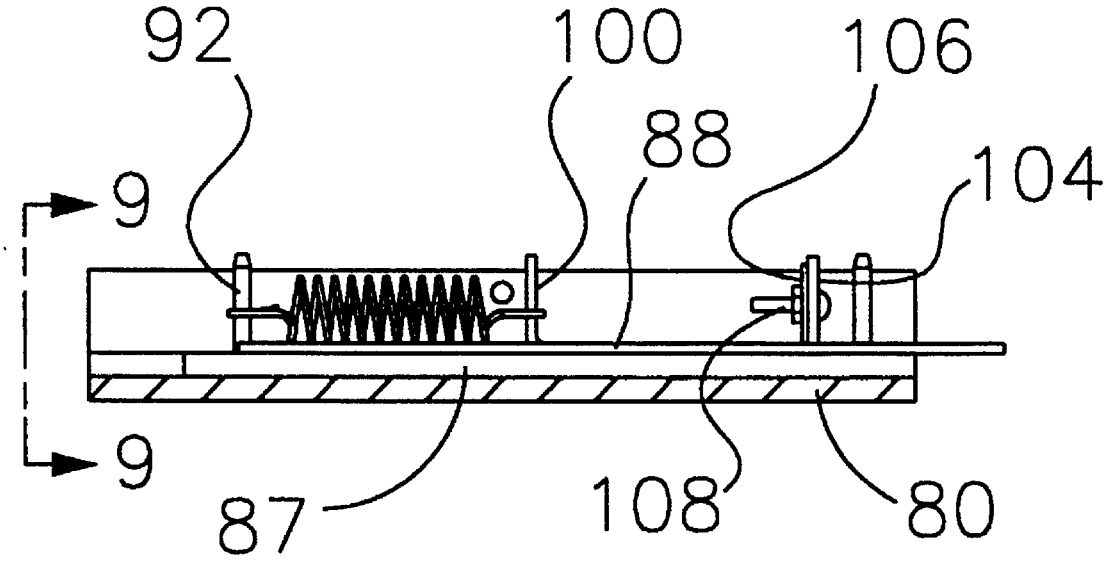
FIG. 8 is a side elevation view of the slide plate and the base plate of the housing taking along 8—8 of FIG. 5.
Figure 9:
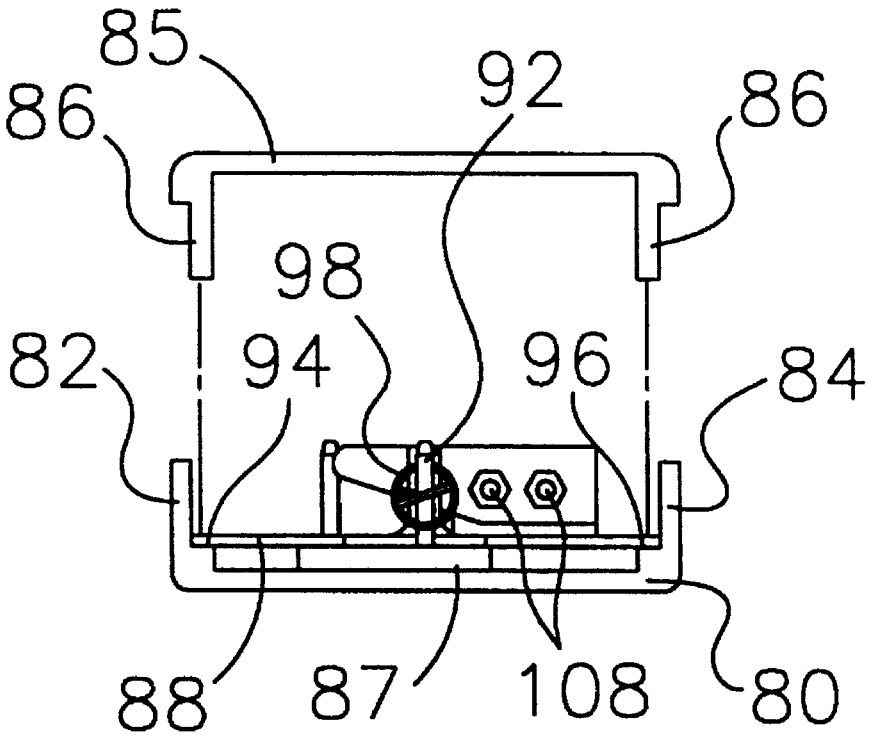
FIG. 9 is an end view of the housing and cover plate taken on line 9—9 of FIG. 8.

FIG. 7 shows further travel of the slide plate outwardly from the belt housing which carries the sounding spring past the pin 90 until an end **102*b* of the slot 102 contacts the pin 90 which acts as a stop against further outward travel of the slide plate from the housing. The slide plate is then able to travel under the bias of the control spring 98 back into the housing and to move the sounding spring 104 into contact with the pin 90 to produce a further audible sound as the slide plate is retracted into the housing toward the at-rest position shown in FIG. 5. The pin 90** acts as a stop against further inward travel of the slide plate as the plate moves to the at-rest position.

The bottom edges of the cover plate legs are spaced from the shoulders 94 and 96 of the base plate to provide narrow-slotted regions for guiding axial travel of the slide plate in and out of the belt housing so as to limit travel to a horizontal plane.

Manufacturing costs of the belt housing of FIGS. 5 through 9 are reduced inasmuch as the slide plate can be manufactured on a punch press to punch out the holes and bend the posts. In addition, there are no required close tolerances on the cover plate as with the embodiment of FIGS. 1 through 4 in locating the sounding spring, and all components are located in the housing independently of the cover plate.

What is claimed is:

1. A posture monitoring and warning device comprising:

a belt housing having a flat base plate, a pair of spaced apart upright side walls extending along the opposite sides of the base plate, and a cover plate secured to the side walls and positioned over the base plate to define a hollow interior region of the belt housing, a slide plate movably disposed over the base plate for sliding travel relative to the base plate in the hollow interior of the housing, the slide plate being movable in an outward direction out of the housing and in a retracted direction into the housing, a sounding spring assembly disposed within the hollow interior of the housing, the sounding spring assembly comprising an elongated flexible leaf spring mounted to one of the slide plate or the base plate and a spring actuating member mounted to the other of the slide plate or to the base plate in alignment with the leaf spring so that the actuating member contacts the sounding spring when the slide plate moves in the outward direction and separately contacts the sounding spring when the slide plate moves in the retracted direction, a control spring secured between the base plate and the slide plate, in which increased tension is applied to the control spring in response to movement of the slide plate in the outward direction, and in which the slide plate is drawn into the housing in the retracted direction by the control spring when tension on the slide plate is released, a belt strap adapted to be secured around the abdominal region of a user to wear the belt housing on the stomach muscle region, the belt strap having one end secured to the base plate portion of the housing and the other end secured to the slide plate, and means for adjusting the length of the belt strap between the slide plate and the housing, the slide plate being movable axially in the housing and in the outward direction against the bias of the control spring under stomach muscle expansion to move the sounding spring and the spring actuating member into contact with each other as the slide plate moves out of the housing to flex the leaf spring and thereby produce a first subtle audible mechanical sound when contact therewith is released, and to thereby produce a similar second subtle audible mechanical sound when the slide plate moves into the housing in the retracted direction to flex the leaf spring upon contact with the actuating member, the belt length being adjustable to control the point at which the audible sounds are produced, the control spring providing a biasing force to retract the slide plate into the housing when the stomach muscle expansion is released.

2. A posture monitoring and warning device comprising:

a belt housing having a flat base plate, a pair of spaced apart upright side walls extending along the opposite sides of the base plate, and a cover plate secured to the side walls and positioned over the base plate to define a hollow interior region of the belt housing, a slide plate movably disposed over the base plate for sliding travel relative to the base plate in the hollow interior of the housing, the slide plate being movable in an outward direction out of the housing and in a retracted direction into the housing, a first post rigidly secured to the base plate inside the housing interior adjacent the slide plate, a second post rigidly secured to the slide plate inside the housing interior spaced from the first post, the slide plate being movable away from the first post for enlarging the spacing between the first and second posts, a flexible sounding spring secured to an underside of the housing cover plate to extend across the housing interior on a side of the second post opposite from the first post, a third post rigidly secured to the slide plate and disposed within the housing interior in alignment with a free end region of the sounding spring for contacting nd flexing the sounding spring when the slide plate moves the third post into contact with the free end region of the sounding spring, a control spring secured between the first and second posts so the slide plate moves away from the first post to increase tension in the control spring, and in which the slide plate is retracted into the housing by the control spring, a belt strap adapted to be secured around the abdominal region of a user to wear the belt housing on the stomach muscle region, the belt strap having one end secured to the base plate portion of the housing and the other end secured to the slide plate, and means for adjusting the length of the belt strap between the slide plate and the housing, the slide plate being movable in the housing against the bias of the control spring to move the third post toward the sounding spring such that movement of the third post engages and flexes the sounding spring and thereby emits a subtle audible mechanical sound, the belt length being adjustable to control the point at which the audible sound is generated, the control spring providing a biasing force to retract the slide plate into the housing and the sounding spring past the third post in the retracted direction when the stomach muscle expansion is released.

3. A posture monitoring and warning device comprising:

a belt housing having a flat base plate, a pair of spaced apart upright side walls extending along the opposite sides of the base plate, and a cover plate secured to the side walls and positioned over the base plate to define a hollow interior region of the belt housing, a slide plate movably disposed over the base plate for sliding travel relative to the base plate in the hollow interior of the housing, the slide plate being movable in an outward direction out of the housing and in a retracted direction into the housing, a flexible sounding spring mounted on the slide plate and extending across the hollow interior of the housing, a spring actuating member mounted in a fixed position on the base plate and disposed within the housing interior in alignment with a portion of the sounding spring for contacting the sounding spring when the slide plate moves in the outward direction, a control spring secured between the base plate and the slide plate, in which increased tension is applied to the control spring in response to movement of the slide plate in the outward direction, and in which the slide plate is retracted into the housing by the control spring when tension on the slide plate is released, a belt strap adapted to be secured around the abdominal region of a user to wear the belt housing on the stomach muscle region, the belt strap having one end secured to the base plate portion of the housing and the other end secured to the slide plate, and means for adjusting the length of the belt strap between the slide plate and the housing, the slide plate being movable in the housing against the bias of the control spring to move the sounding spring into contact with the spring actuating member to thereby produce a subtle audible mechanical sound, the belt length being adjustable to control the point at which the audible sound is generated, the control spring providing a biasing force to retract the slide plate into the housing when the stomach muscle expansion is released.

4. Apparatus according to claim 3, in which the spring actuating member extends through a slot in the slide plate, and in which opposite ends of the slot contact the actuating member to act as stops defining opposite ends of travel of the slide plate.

* * * * *